US007176932B2

(12) United States Patent
Lai et al.

(10) Patent No.: US 7,176,932 B2
(45) Date of Patent: Feb. 13, 2007

(54) METHOD FOR ADJUSTING ATTRIBUTE OF VIDEO SIGNAL

(75) Inventors: Chun-Teng Lai, Taichung (TW); Min-Jye Chen, Miaoli (TW); Yun-Wen Liu, Pingjhen (TW)

(73) Assignee: BenQ Corporation, Taoyuan (TW)

( * ) Notice: Subject to any disclaimer, the term of this patent is extended or adjusted under 35 U.S.C. 154(b) by 66 days.

(21) Appl. No.: 10/924,369
(22) Filed: Aug. 23, 2004

(65) Prior Publication Data

US 2005/0062752 A1 Mar. 24, 2005

(30) Foreign Application Priority Data

Sep. 19, 2003 (TW) ..... 92125901 A

(51) Int. Cl.
*G09G 5/00* (2006.01)

(52) U.S. Cl. ..... 345/581

(58) Field of Classification Search ..... 345/3.4, 345/581, 669, 699, 135 FOR; 348/69, 211.5, 348/425.3, 429.1, 432, 1, 455, 460, 469, 348/474, 575, 604, 640, 641, 739, 760, 766, 348/152 FOR; 715/716, 718, 719, 722; 725/20, 725/38, 136

See application file for complete search history.

(56) References Cited

U.S. PATENT DOCUMENTS 6,049,316 A * 4/2000 Nolan et al. ..... 345/698
6,314,479 B1 * 11/2001 Frederick et al. ..... 710/63

* cited by examiner

*Primary Examiner*—Kee M. Tung
*Assistant Examiner*—G. F. Cunningham
(74) *Attorney, Agent, or Firm*—Snell & Wilmer L.L.P.

(57) ABSTRACT

A method for adjusting attributes of a video signal within a system is disclosed. The system includes a display device and a host. The display device has a first signal attribute specification, and the video signal has a second signal attribute specification. The first step of this method is to output a video signal from the host. The display device responds with a status signal to the host according to the first and the second signal attribute specifications. Afterward, the host can modify the attributes of the video signal according to the status signal.

9 Claims, 4 Drawing Sheets

METHOD FOR ADJUSTING ATTRIBUTE OF VIDEO SIGNAL

CROSS-REFERENCE TO RELATED APPLICATIONS

This application claims priority of Taiwan Patent Application Serial No. 092125901 entitled "Method for Adjusting Attribute of Video Signal," filed Sep. 19, 2003.

FIELD OF INVENTION

The present invention relates to an adjusting method for modifying attributes of a video signal. In particular, it relates to an adjusting method for automatically detecting the signal attribute specification of the display device and for modifying the video signal attribute specification to a proper setting.

BACKGROUND OF THE INVENTION

The cathode ray tube monitor is the traditional display device for the personal computer. Flat display devices, such as LCD monitors, offer several advantages over CRT monitors because they emit less radiation, consume less power and take up less space. As technology advances and prices of display devices fall, flat display devices are replacing traditional CRT monitors. However, updating the monitor comes with an annoying problem—the re-configuration of the video signal.

FIG. 5 is a flowchart illustrating the well-known displaying process between a computer host and a display device. In step 502, the host outputs a video signal to the display device. Typically, each display device has its own acceptable signal attribute specification, such as horizontal frequency, vertical frequency, resolution and the like. When the display device receives the video signal, it determines whether the video signal is acceptable or not (step 504). When the video signal is in line with acceptable specification, the video signal is properly displayed (step 506). When the video signal is outside the range of the acceptable specification, however, the display device responds by displaying an error message to prompt the user to re-configure the attributes of the video signal.

This circumstance usually occurs when the user replaces the old monitor with a new one that does not support the original configuration. For example, a user installs a new monitor that supports a maximum frequency of 75 Hz while the original configuration of video signal frequency is at 85 Hz. When the display device cannot handle the video signal, a traditional monitor simply leaves an error message on the screen, such as "Out of range." The system cannot take any steps, such as automatic re-configuration, to solve the problem. Indeed, user intervention, such as rebooting or manual re-configuration, is required before the display device can properly display the video signal.

The traditional process is complicated, time-consuming, and not user-friendly. Moreover, it requires additional knowledge and skills on the user's part to complete the manual re-configuration process. Therefore, there exists a demand for an adjusting method for automatically detecting the attribute specification of a display device and automatically modifying the attributes of the video signal.

SUMMARY OF THE INVENTION

It is one aspect of the present invention to provide an adjusting method for automatically reading the attribute specification of a display device.

It is another aspect of the present invention to provide an adjusting method for automatically modifying attributes of a video signal to comply with the attribute specification of the display device.

The present invention discloses an adjusting method to modify attributes of a video signal within a system. The system includes a display device and a host. The method includes outputting a video signal from the host to the display device. The display device has a first signal attribute specification, and the video signal has a second signal attribute specification, which contains the attributes of the video signal. The display device sends a status signal to the host according to the first signal attribute specification and the second signal attribute specification. The host modifies the attributes of the video signal according to the status signal.

After comparing the first and the second signal attribute specifications, the display device responds with a status signal of a first state when the second signal attribute specification does not comply with the first signal attribute specification. Subsequently, the host automatically reads the first signal attribute specification of the display device, and modifies the attributes of the video signal to comply with the first signal attribute specification.

In addition, the first signal attribute specification further includes a default value. After comparing the first and the second signal attribute specifications, the display device responds with a status signal of a second state when the second signal attribute specification complies with the first signal attribute specification but does not equal the default value. Subsequently, the host automatically reads the default value and determines whether or not to modify the attributes of the video signal to comply with the default value of the first signal attribute specification.

DETAILED DESCRIPTION

Figure 1:
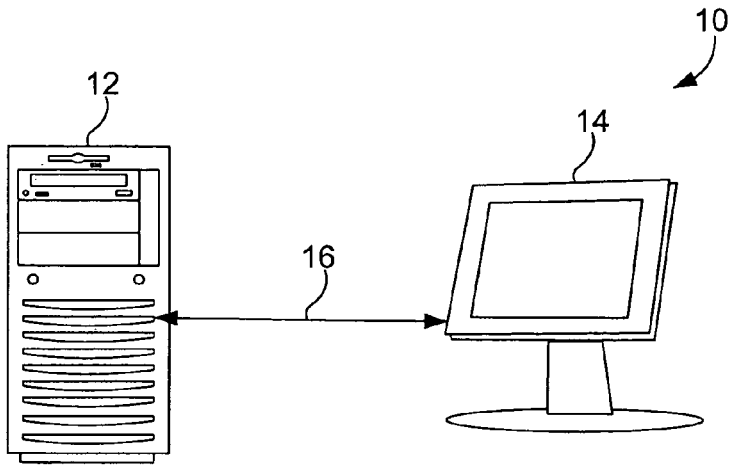
FIG. 1 shows a system to which the method is applied in accordance to one embodiment of the present invention.

The present invention discloses a method for adjusting attributes of a video signal within a system. Referring to FIG. 1, the system 10 includes a host 12 and a display device 14. The host 12 and the display device 14 are connected by a communication interface 16. The host 12 of the present invention may be a personal computer, a notebook, or other electronic devices with similar functions. The display device 14 may be a cathode-ray-tube monitor, a liquid crystal display monitor, or other display devices with similar functions. In this embodiment, the communication interface 16 is a D-Sub connector, which complies with the display data channel (DDC) standard; however, the present invention is not limited to the exemplary embodiment. The display data channel is a communication interface between the monitor and the computer and an architecture developed to support the plug and play function.

Figure 2:
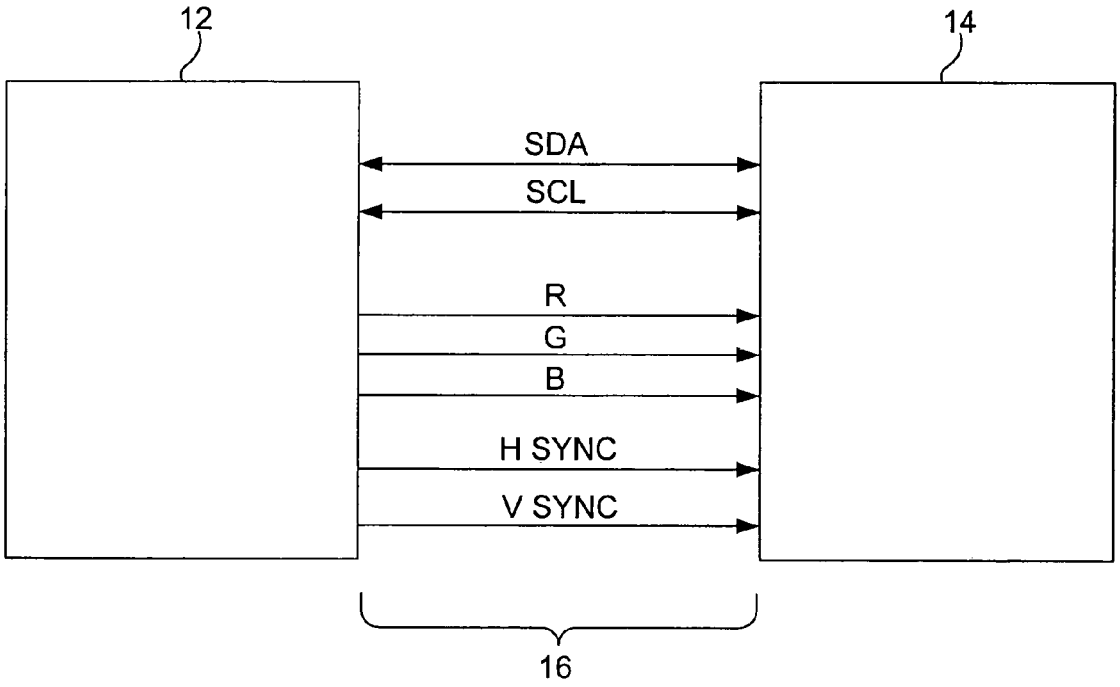
FIG. 2 shows a communication interface to which the method is applied in accordance to an embodiment of the present invention.

FIG. 2 illustrates the data included in the display data channel. The display data channel includes video signals such as R, G, and B signals, synchronous signals such as H-Sync and V-Sync signals, and additional signals such as SDA and SCL signals. The SDA signal carries additional information of the display device such as the brand name, the serial number, and the resolution information. The SCL signal carries the synchronous clock of the SDA signal. DDC1 is the basic interface standard of the DDC architecture, and DDC2B is another interface standard supporting Windows 95 or newer versions. One embodiment of the present invention utilizes the SDA and SCL signals to carry required information.

Figure 3:
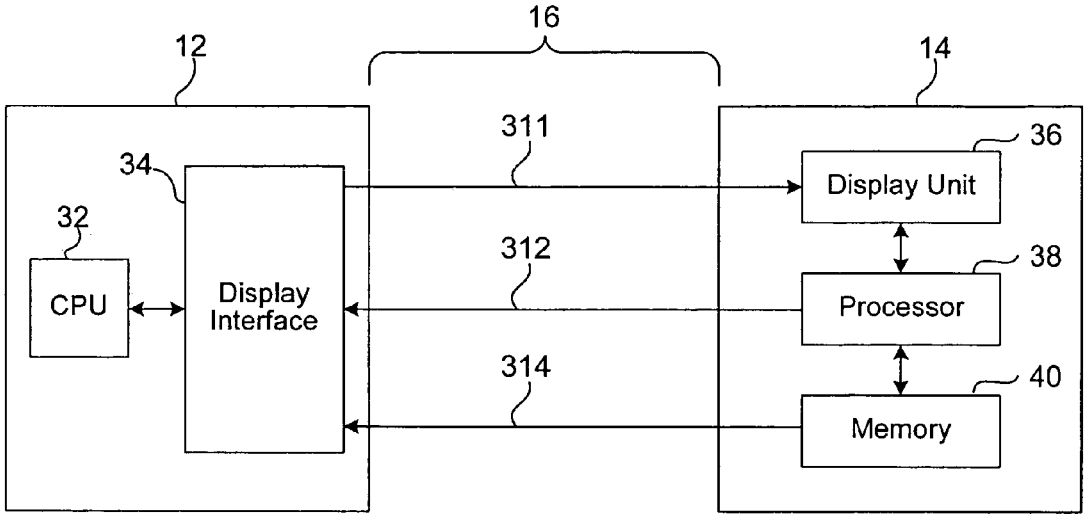
FIG. 3 is a block diagram in accordance with an embodiment of the present invention.

FIG. 3 shows a method in accordance with one embodiment of the present invention. The host 12 includes a central processing unit 32 (CPU) and a display interface 34. The display device 14 includes a display unit 36, a processor 38, and a memory 40. CPU 32 transmits video signal 311 through the display interface 34 to drive the display unit 36 of the display device 14. Display device 14 has a first signal attribute specification stored in the memory 40. The video signal 311 has a second signal attribute specification, which contains attributes of the video signal. The first and the second signal attribute specifications may include any attributes of the video signal 311 such as the horizontal frequency, the vertical frequency, or the resolution. After the video signal 311 is outputted to the display device 14, the processor 38 compares the first signal attribute specification stored in the memory 40 with the second signal attribute specification of the video signal 311. The display device 14 sends a status signal 312 to the host 12 according to the first and the second signal attribute specifications. When the second signal attribute specification does not comply with the first signal attribute specification, the status signal 312 is in a first state. When the host 12 receives the status signal 312 of the first state, the host 12 automatically reads the first signal attribute specification stored in the memory 40 of the display device 14 through the signal line 314 of the communication interface 16, such as a DDC2B interface. Afterward, the host 12 modifies the attributes of the video signal 311 so that they comply with the first signal attribute specification.

In one embodiment, the method of the present invention is implemented between a personal computer and a monitor. Even if the user replaces the old monitor with a newer one that does not support the original configuration of the video signal, the monitor can still automatically send a status signal to the personal computer. The personal computer automatically reads the signal attribute specification of the display device according to the status signal, and then modifies the attributes of the video signal to comply with the signal attribute specification of the display device. Thus, additional rebooting or manual configuration are not needed. Moreover, no additional knowledge or skills are required on the user's part.

Figure 4:
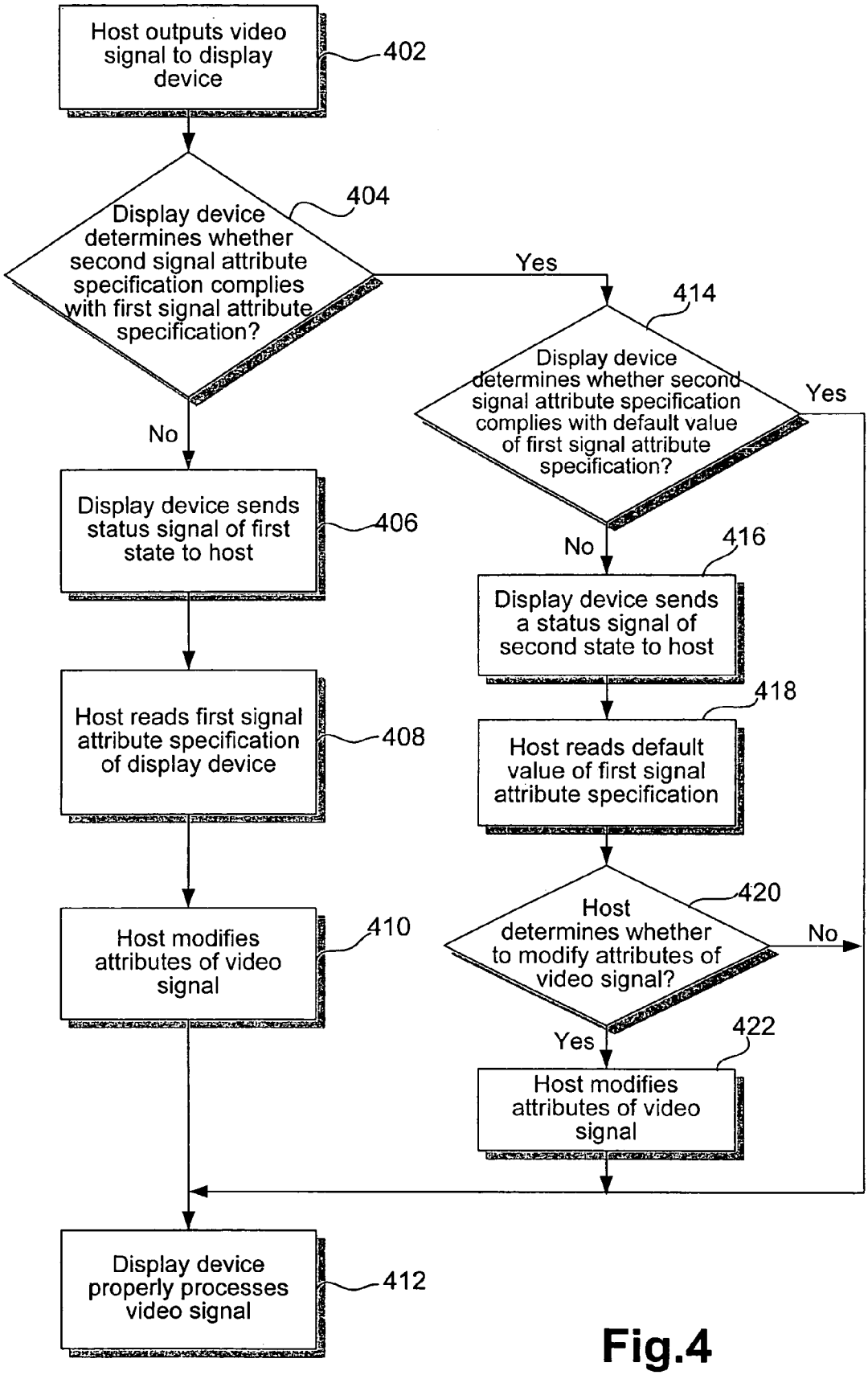
FIG. 4 is a flowchart in accordance to an embodiment of the present invention.
Figure 5:
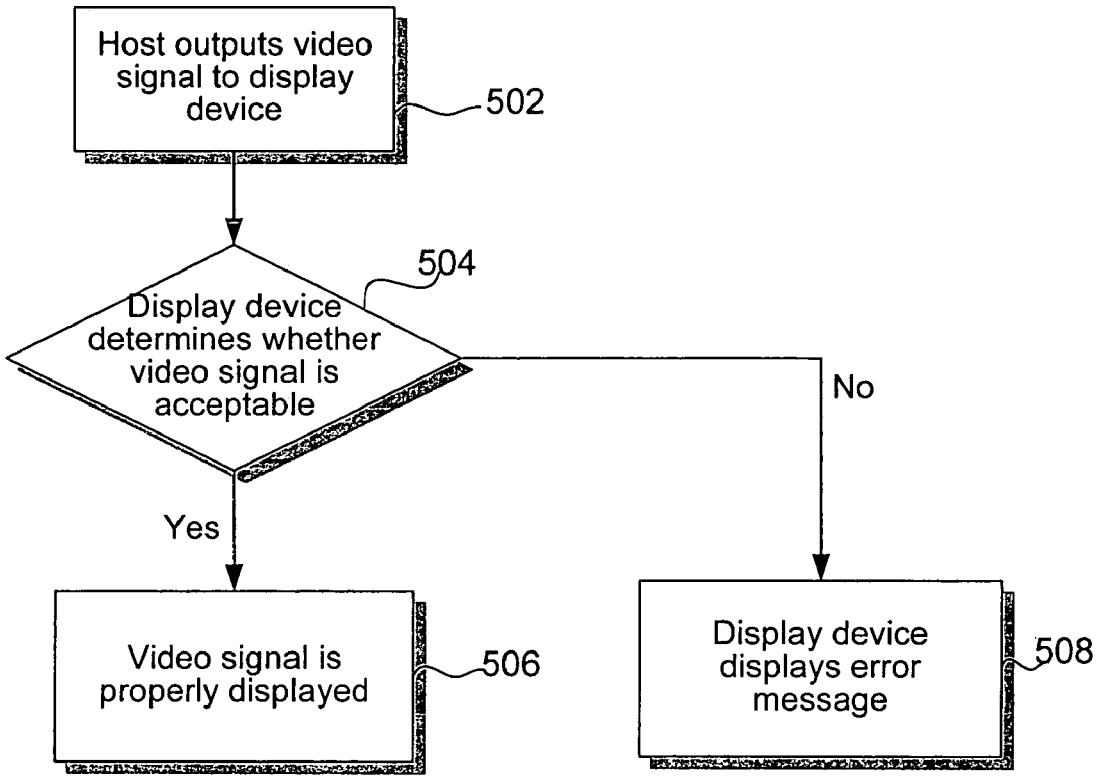
Fig.5(PRIOR ART)
FIG. 5 shows a flowchart of a prior art.

FIG. 4 illustrates a flow chart of the method in accordance with another embodiment of the present invention. The flow chart provides a better understanding of the present invention. In this embodiment, the method is implemented between a host and a display device. The display device has a first signal attribute specification, and the first signal attribute specification further includes a default value. The method begins with the step 402, wherein the host outputs a video signal to the display device. The video signal has a second signal attribute specification. Note that the first signal attribute specification is within the acceptable range of the video signal. In other words, the display device can properly display the video signal with this first signal attribute specification. The default value is the best or recommended attributes for the first signal attribute specification.

In step 404, the display device determines whether the second signal attribute specification complies with the first signal attribute specification. When the second signal attribute specification does not comply with the first signal attribute specification, it means that the display device cannot properly process the video signal. The display device then sends a status signal of the first state to the host (step 406). In step 408, the host automatically reads the first signal attribute specification of the display device. In step 410, the host then modifies the attributes of the video signal to comply with the first signal attribute specification. In step 412, the display device may properly process the video signal since the attributes of the video signal have been modified to comply with the first signal attribute specification.

In step 404, if the second signal attribute specification complies with the first signal attribute specification, the process proceeds to step 414. In step 414, the display device determines whether the second signal attribute specification complies with the default value of the first signal attribute specification. When the second signal attribute specification complies with the first signal attribute specification but is not equal to the default value, it means the display device can properly process the video signal, but the display device is not working in the best mode. The display device then responds a status signal of a second state to the host (step 416). In step 418, the host automatically reads the default value of the first signal attribute specification. It should be noted that, in this case, the second signal attribute specification does not comply with the default value of the first signal attribute specification, but the display device still can process the video signal. Therefore, in step 420, the host determines whether to modify the attributes of the video signal to comply with the default value of the first signal attribute specification or not. In this embodiment, users may choose the display mode. They can decide to adopt the recommended display mode or not in step 420, according to their own preferences or specific purposes. When the host decides to modify the attribute of the video signal, the process proceeds to step 422. In step 422, the host modifies the attributes of the video signal to comply with the default value of the first signal attribute specification. The process finally proceeds to step 412 where the display device can process the video signal in the best mode.

The above detailed description of the preferred embodiments provides a clear understanding of the present invention. However, the embodiments are not intended to limit the scope of the invention. Contrarily, various modifications of the illustrative embodiments, as well as other embodiments of the invention, will be apparent to persons skilled in the art upon reference to this description. It is therefore contemplated that the appended claims will cover any such modifications or embodiments as falling within the true scope of the invention.

The invention claimed is:

1. A method for adjusting attributes of a video signal within a system including a display device and a host, the display device having a first signal attribute specification, the method comprising:

said host outputting a signal to the display device, said signal carrying a second signal attribute specification;

said display device comparing said first signal attribute specification with said second signal attribute specification;

said host receiving a status signal responded by the display device based on the comparison; and said host determining whether to modify the attributes of the video signal according to the status signal.

2. The method of claim 1, wherein the status signal is a first state when the second attribute specification does not comply with the first signal attribute specification; and said host reads the first signal attribute specification from said display device and modifies the attributes of the video signal to comply with the first signal attribute specification when the status signal is the first state.

3. The method of claim 1, wherein the first signal attribute specification further comprises a default value;

the status signal is a second state when the second attribute specification complies with the first signal attribute specification but is not equal to the default value; and said host reads the default value from said display device and determines whether to modify the attributes of the video signal when the status signal is the second state.

4. The method of claim 3, wherein:

the attributes of the video signal are made to comply with the default value when determined to modify the attributes of the video signal.

5. The method of claim 1, wherein the first signal attribute specification comprises a scan frequency and a resolution of the display device.

6. A method for adjusting attributes of a video signal within a system including a display device and an electronic device, the display device having a first signal attribute specification, the method comprising:

the electronic device outputting a signal to the display device, the signal carrying a second signal attribute specification;

said display device comparing said first signal attribute specification with said second signal attribute specification;

the display device responding a status signal according to the comparison;

the electronic device reading the first signal attribute specification according to the status signal; and the electronic device determining whether to modify the attributes of the video signal.

7. The method of claim 6, wherein the status signal is a first state when the second attribute specification does not comply with the first signal attribute specification; and said host modifies the attributes of the video signal when the status signal is the first state.

8. The method of claim 6, wherein the first signal attribute specification further comprises a default value;

the status signal is a second state when the second attribute specification complies with the first signal attribute specification but is not equal to the default value; and the electronic device determines whether to modify the attributes of the video signal to comply with the default value of the first signal attribute specification when the status signal is the second state.

9. The method of claim 6, wherein the first signal attribute specification comprises a scan frequency and a resolution of the display device.

* * * * *